US008267709B2

(12) United States Patent
Taketomi

(10) Patent No.: US 8,267,709 B2
(45) Date of Patent: Sep. 18, 2012

(54) FPC CONNECTOR

(75) Inventor: Kousuke Taketomi, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/026,594

(22) Filed: Feb. 14, 2011

(65) Prior Publication Data

US 2011/0201220 A1 Aug. 18, 2011

(30) Foreign Application Priority Data

Feb. 12, 2010 (JP) ..... 2010-029457

(51) Int. Cl.
*H01R 13/62* (2006.01)

(52) U.S. Cl. ..... 439/329; 439/260

(58) Field of Classification Search ..... 439/329, 439/260, 495
See application file for complete search history.

(56) References Cited

U.S. PATENT DOCUMENTS 7,275,948 B2 * 10/2007 Miura et al. ..... 439/260
7,435,122 B2 * 10/2008 Suzuki et al. ..... 439/260
2005/0255732 A1 * 11/2005 Sunaga ..... 439/260
2006/0178039 A1 * 8/2006 Chen ..... 439/495

FOREIGN PATENT DOCUMENTS

| | | |
|---|---|---|
| JP | H10-372432 | 9/1999 |
| JP | H11-304515 | 5/2001 |
| JP | 2000-281131 | 3/2002 |
| JP | 2002-040134 | 8/2003 |
| JP | 2002-342832 | 6/2004 |
| JP | 2005-362781 | 6/2007 |
| JP | 2006-125590 | 11/2007 |

* cited by examiner

*Primary Examiner* — Tulsidas C Patel
*Assistant Examiner* — Travis Chambers
(74) *Attorney, Agent, or Firm* — Timothy M. Morella

(57) ABSTRACT

To provide a connector that increases the amount of elastic deformation of a beam and can improve the contact stability between a flat electrical wire and a terminal while restraining an increase in the difference between the position of a cam in the anteroposterior direction and the position of a pressing portion formed on the cam, a pressing portion that pushes flat electrical wire is formed on the lower surface of center beam of rear connecting terminal. Cam of actuator is positioned between upper beam and center beam of rear connecting terminal. Inclined surface that extends at an angle upward and backward is formed on the upper surface of center beam. Cam pushes inclined surface down.

5 Claims, 7 Drawing Sheets

FPC CONNECTOR

REFERENCE TO RELATED APPLICATIONS

The Present application claims priority to prior-filed Japanese Patent Application No. 2010-029457, entitled "Connector," filed on 12 Feb. 2010 with the Japanese Patent Office. The content of the aforementioned patent application is fully incorporated in its entirety herein.

BACKGROUND OF THE PRESENT APPLICATION

The Present application relates generally to a connector that can connect to a flat electrical wire. More specifically, the Present application relates to technology for improving the contact stability between a terminal and the conductor of a flat electrical wire.

In a conventional connector, an actuator that locks an inserted flat electrical wire to the connector is located in the front portion of the connector. In the connector disclosed in Japanese Patent Application No. 2002-093504, each terminal has three beams extending forward (namely, an upper beam, a lower beam and a center beam located between the upper beam and lower beam). A cam formed in an actuator is located between the upper beam and center beam, and can rotate between the location where the center beam is pressed downward and the location where the pressure on the center beam is terminated. A pressing portion that projects downward is formed on the lower surface of the center beam. When the center beam is pushed down via the cam, the pressing portion of the center beam pushes the flat electrical wire against the lower beam. As a result, there is an electrical connection between the terminal and the flat electrical wire.

In the connector disclosed in the '504 Application, the cam of the actuator pushes the center beam downward at a separate position backward from the pressing portion of said center beam. According to this structure, the center beam is pushed down via the cam, and after the pressing portion contacts the flat electrical wire, a moment is generated around the pressing portion by the effort force of the cam on the center beam. As a result, the center beam is elastically deformed so that the center beam is distended downward with the pressing portion as the fulcrum. This improves the contact stability between the terminal and the flat electrical wire.

In order to increase the amount of elastic deformation of the center beam with the pressing portion as the fulcrum and improve the contact stability between the terminal and the flat electrical wire, there is a need for an increase in the distance between the pressing portion of the center beam and the location on the center beam where the cam presses. However, when selecting the position of the cam, it is also necessary to consider the position of the other members, so it is sometimes difficult to locate the cam in a position greatly separated backward from the position of the pressing portion.

SUMMARY OF THE PRESENT APPLICATION

The Present application was carried out by taking the above problem into account. Its purpose is to provide a connector that increases the amount of elastic deformation of the beam and can improve the contact stability between the flat electrical wire and the terminal while restraining the increase in the difference between the position of the cam in the anteroposterior direction and the position of the pressing portion formed on the cam. In order to resolve the above problem, the connector claimed in the Present application comprises a terminal comprising a first beam that extends forward from a base portion and a second beam positioned downward from said first beam that extends forward from said base portion. A pressing portion for pushing said flat electrical wire positioned downward from said second beam is formed on the lower surface of said second beam. In addition, said connector comprises an actuator, and said actuator comprises a cam that can rotate between the pushing position where said second beam is pressed downward and the location where the pressure on said second beam is terminated, wherein the cam is positioned between said first beam and said second beam. An inclined surface that extends at an angle upward and backward with at least a portion positioned more backward than said pressing portion is formed on the upper surface of said second beam. Said cam positioned at said pushing position pushes on at least said portion of said inclined surface.

According to the connector claimed in the Present application, the distance between the position on the center beam where the cam presses and the pressing portion is increased, while the increase in the difference between the position of the cam in the anteroposterior direction and the position of the pressing portion formed on the cam is restrained. Consequently, the moment around the pressing portion generated by the pressure of the cam on the center beam can be increased. As a result, the amount of elastic deformation of the beam is increased, and the contact stability between the terminal and the flat electrical wire can be improved.

In one mode of the Present application, a convex portion that projects at an angle upward and backward from the upper surface of said second beam may be formed on said second beam. Then, said inclined surface may be formed on the upper surface of said convex portion. This mode makes it easy to elastically deform the second beam. In short, if the second beam is partially thickened in order to form the inclined surface on the upper surface of the second beam, this increases the rigidity of the second beam and makes it difficult to elastically deform the second beam. According to this mode, the convex portion projects at an angle upward and backward, and because the inclined surface is formed on this convex portion, the partial thickening of the second beam can be restrained, and it becomes easy to elastically deform the second beam.

In addition, in another mode of the Present application, said inclined surface may extend at an angle upward and backward from a more backward position than the lowest point of said pressing portion. This mode makes it easy to maintain a sufficient distance between the lowest point of the pressing portion and the cam positioned on the inclined surface.

In addition, in another mode of the Present application, the foremost surface of said actuator may be positioned forward from the front end of said terminal when said cam is positioned at said termination position. According to this mode, the front end of the terminal can be protected by the actuator.

BRIEF DESCRIPTION OF THE FIGURES

The organization and manner of the structure and operation of the Present application, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present application may be susceptible to embodiment in different forms, there is shown in the Figures, and will be described herein in detail, specific embodiments, with the understanding that the disclosure is to be considered an exemplification of the principles of the Present application, and is not intended to limit the Present application to that as illustrated.

In the embodiments illustrated in the Figures, representations of directions such as up, down, left, right, front and rear, used for explaining the structure and movement of the various elements of the Present application, are not absolute, but relative. These representations are appropriate when the elements are in the position shown in the Figures. If the description of the position of the elements changes, however, these representations are to be changed accordingly.

Figure 1:
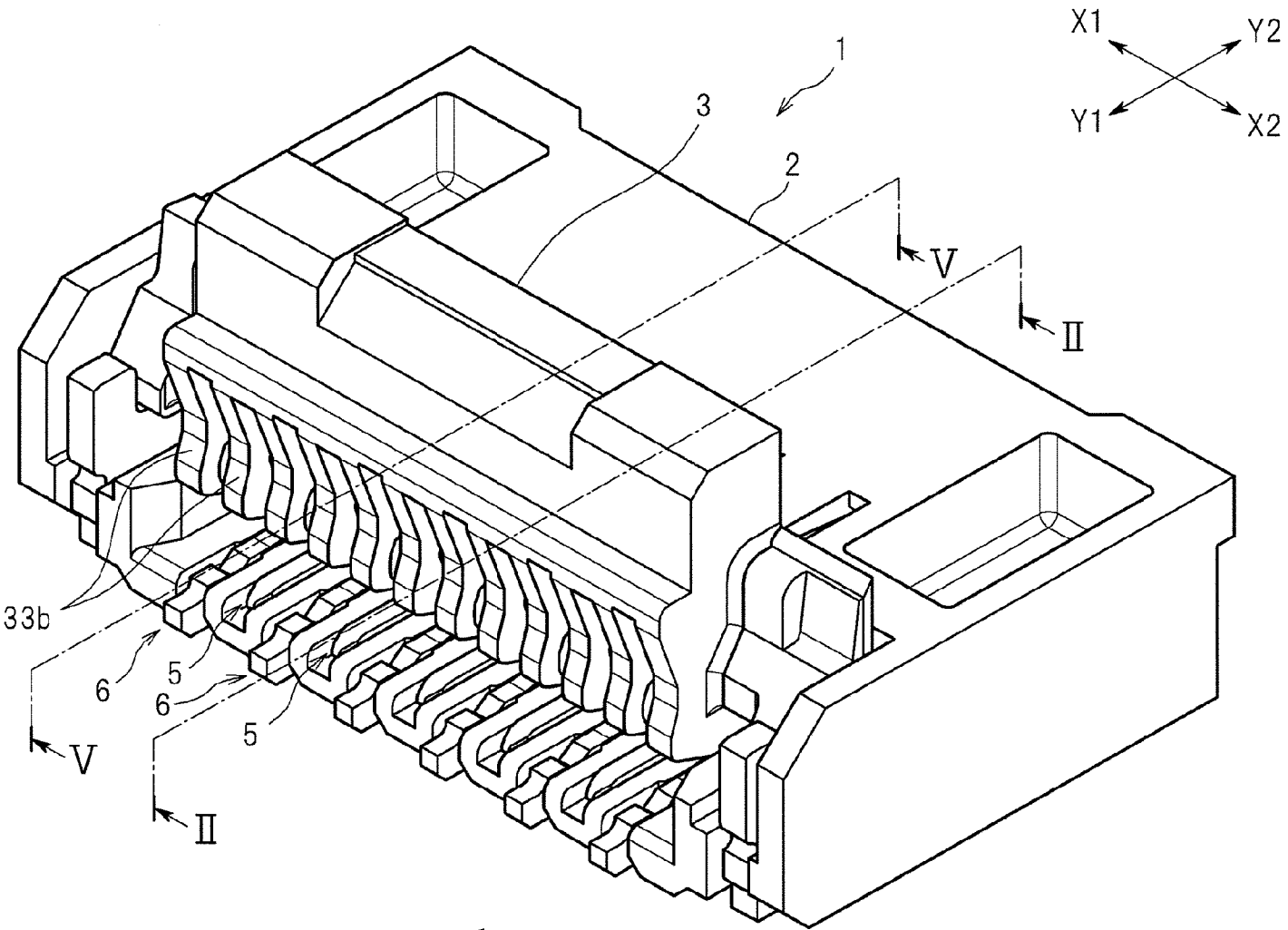
FIG. 1 is a perspective view of the connector of the Present application.
Figure 3:
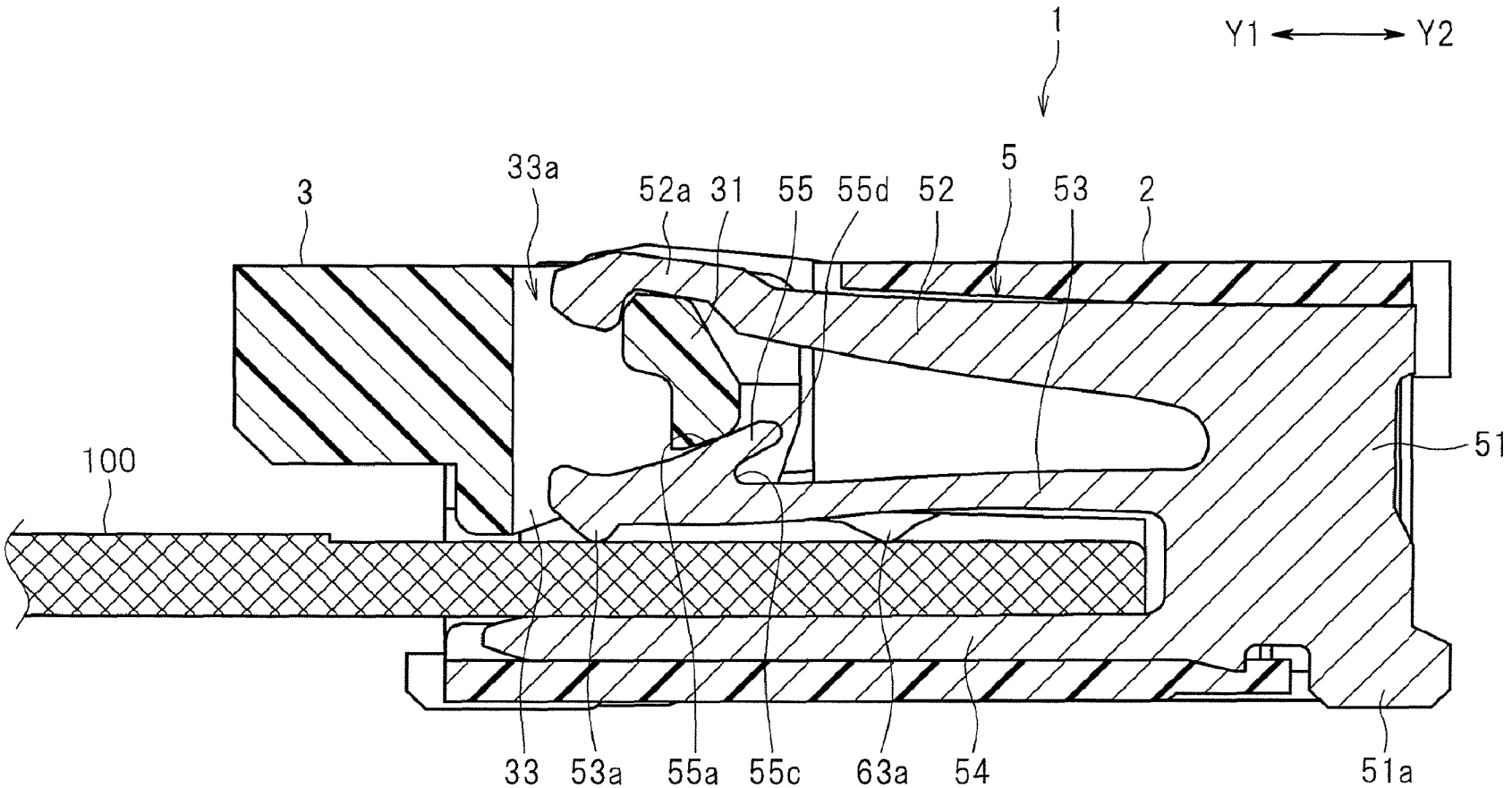
FIG. 3 is a sectional view of connector of FIG. 1 obtained by the same cross section as FIG. 2 (the rear connecting terminal, after the actuator of the connector has fallen forward, is shown in FIG. 3)
Figure 6:
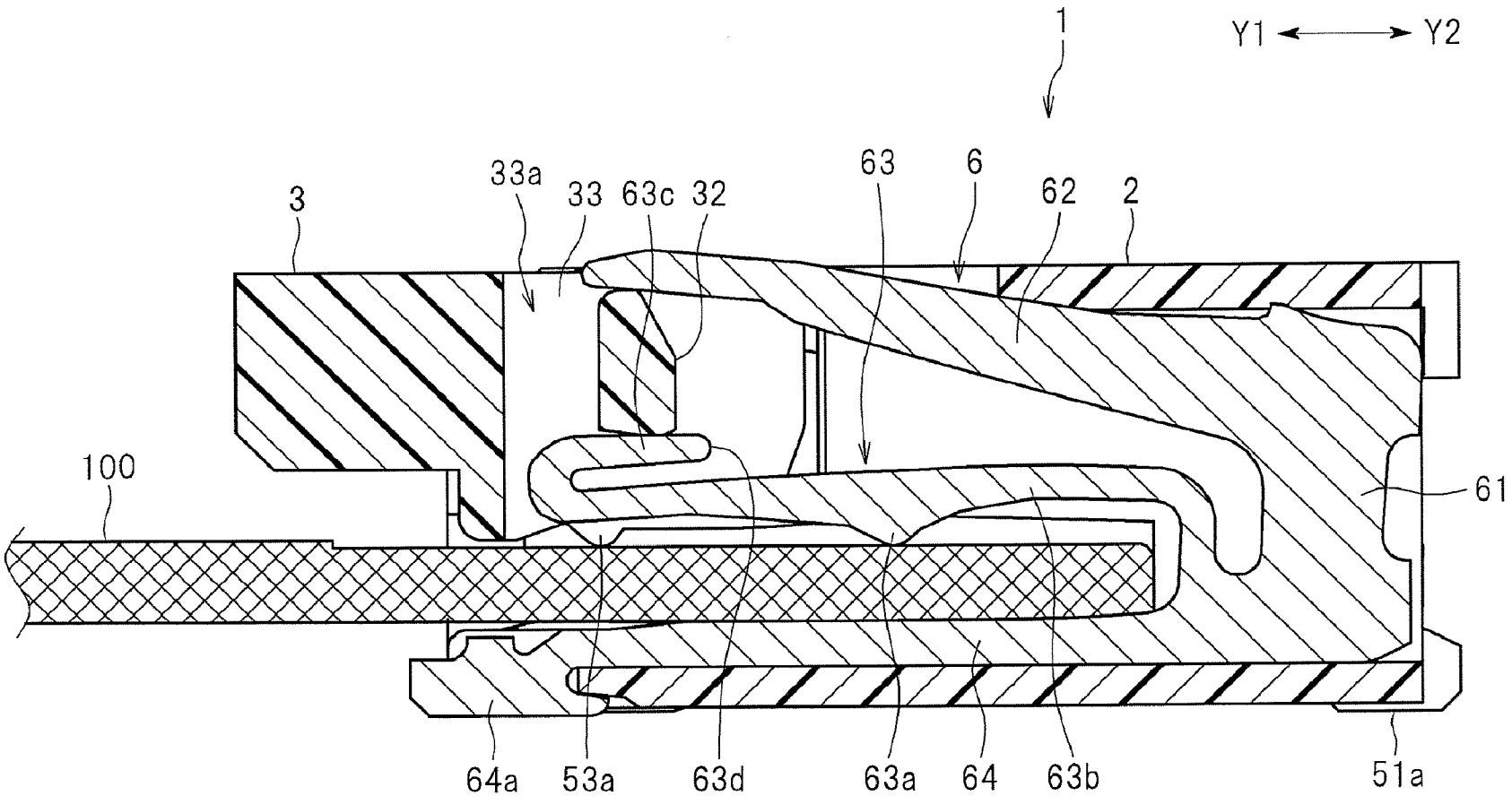
FIG. 6 is a sectional view of the connector obtained by the same cross section as FIG. 5 (the front connecting terminal after the actuator has fallen forward is shown in FIG. 6)

Referring to the Figures, connector 1 is a connector that can connect to flat electrical wire 100, such as flexible printed circuits (FPC) and flexible flat cable (FFC) (see FIGS. 3 6). Multiple conductor pathways (not shown) extending along the direction of the length of said flat electrical wire 100 are formed on the surface of flat electrical wire 100. As shown in FIG. 1, connector 1 comprises multiple terminals 5 and 6 that connect electrically to the conductor pathways. Multiple terminals 5 and 6 are lined up in the left-right direction (the direction shown by X1-X2, the direction of the width of flat electrical wire 100). In this case, connector 1 comprises rear connecting terminal 5 and front connecting terminal 6. Rear connecting terminal 5 and front connecting terminal 6 are positioned in an alternating way. In addition, connector 1 comprises housing 2 that holds rear connecting terminal 5 and front connecting terminal 6. Further, connector 1 comprises actuator 3 for locking flat electrical wire 100 inserted into connector 1 to connector 1. Connector 1 is a what is called a front lock type of connector. Actuator 3 is positioned on the front portion of connector 1.

Figure 2:
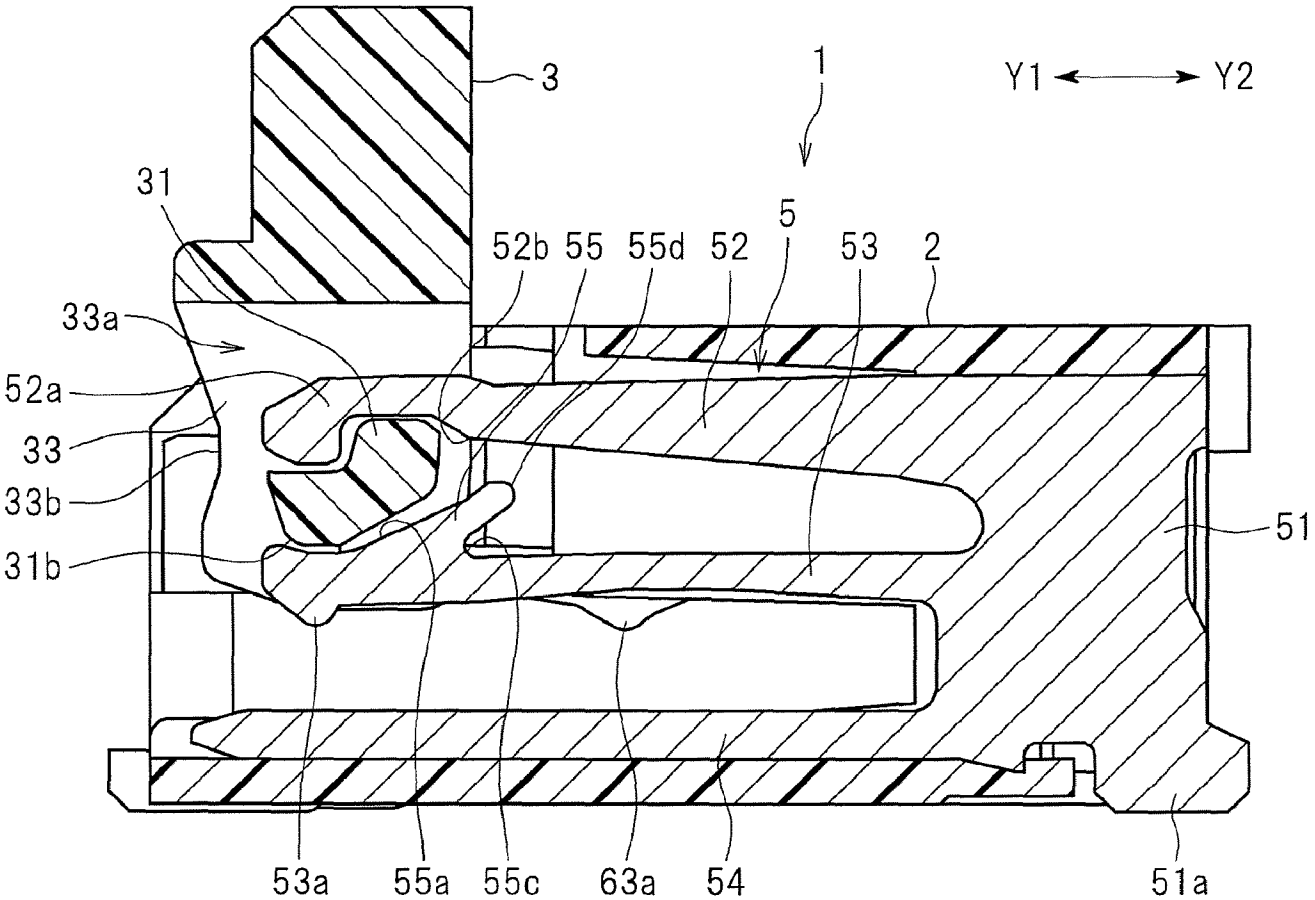
FIG. 2 is a sectional view along Line II-II of FIG. 1 (the rear connecting terminal of the connector is not shown in FIG. 2)

As shown in FIG. 2, rear connecting terminal 5 comprises base portion 51 positioned on the rear portion of connector 1. Connecting portion 51*a* that is soldered to the conductor formed on the circuit board (not shown) to which the connector 1 is mounted during use of connector 1 is formed on the lower end of the most rear portion of base portion 51. In addition, rear connecting terminal 5 comprises upper beam 52 (the first beam in the claims) that extends forward from base portion 51 (the direction shown by Y1, the opposite direction from the direction flat electrical wire 100 is inserted) and center beam 53 (the second beam in the claims) positioned downward from upper beam 52, also extending forward from base portion 51. Further, rear connecting terminal 5 comprises lower beam 54. Lower beam 54 is positioned downward from center beam 53, also extending forward from base portion 51. Thus, center beam 53 is positioned between upper beam 52 and lower beam 54.

As shown in FIG. 3, when connector 1 is being used, flat electrical wire 100 is inserted from the forward direction between center beam 53 and lower beam 54, and inserted flat electrical wire 100 is positioned downward from center beam 53. Pressing portion 53*a* that projects downward is formed on the lower surface of center beam 53. In this case, pressing portion 53*a* is formed on the front end of center beam 53. As previously stated, actuator 3 comprises cam 31 for pushing down on center beam 53. The lowest point of pressing portion 53*a* pushes flat electrical wire 100 against lower beam 54 when center beam 53 is pushed down via cam 31. This electrically connects rear connecting terminal 5 and the conductor pathways formed on flat electrical wire 100. In this example, pressing portion 53*a* contacts the conductor pathways because they are formed on the upper surface of flat electrical wire 100. However, conductor pathways may also be formed on the lower surface of flat electrical wire 100. In this case, lower beam 54 contacts the conductor pathways of flat electrical wire 100.

Figure 5:
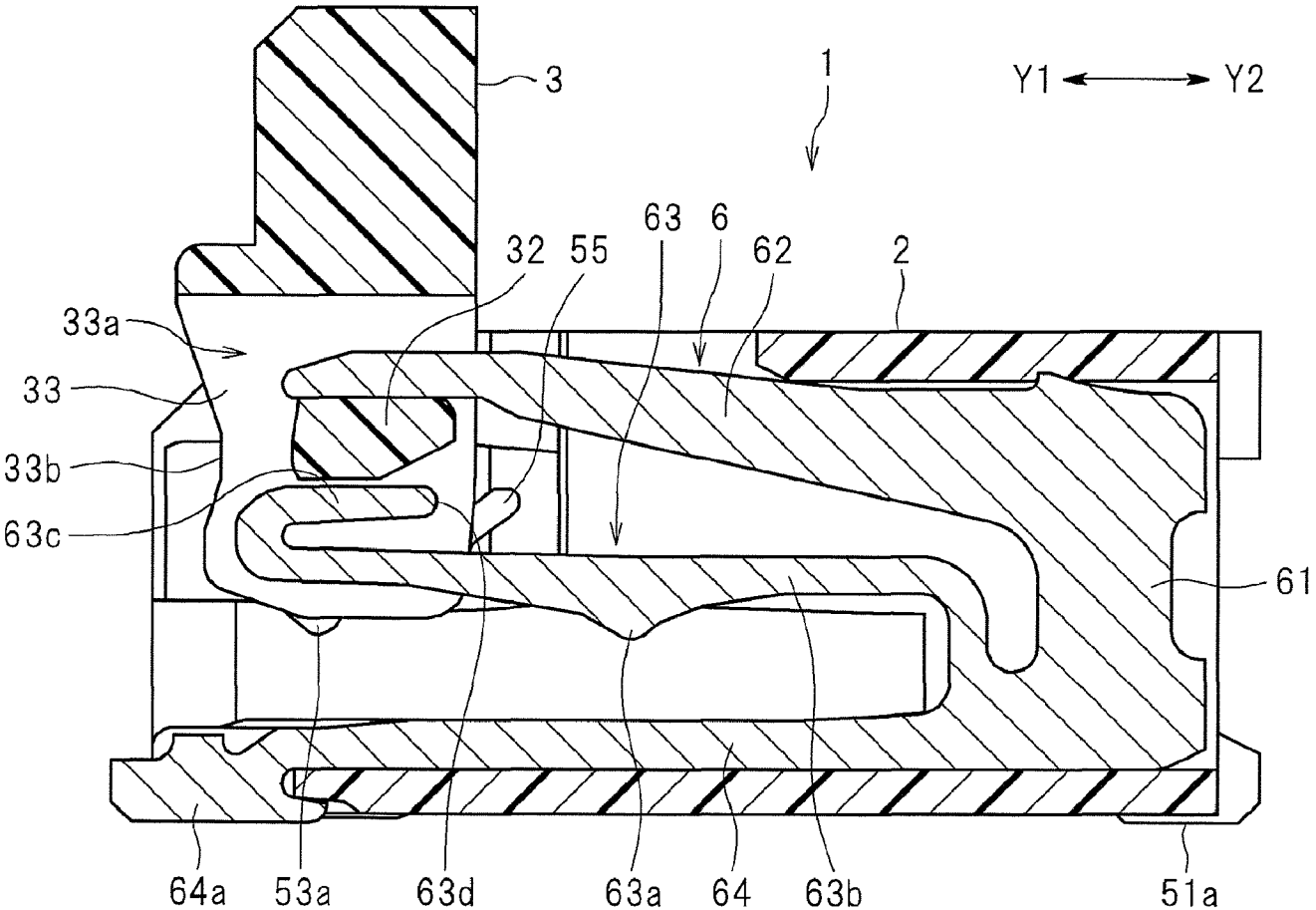
FIG. 5 is a sectional view along the Line V-V of FIG. 1 (the front connecting terminal of the connector is not shown in FIG. 5)

As shown in FIG. 5, front connecting terminal 6 comprises base portion 61 positioned on the rear portion of connector 1. In addition, front connecting terminal 6 comprises upper beam 62 that extends forward from the upper portion of base portion 61 and lower beam 64 that extends forward from the lower portion of base portion 61. Further, front connecting terminal 6 comprises center beam 63 positioned between upper beam 62 and lower beam 64, also extending forward from base portion 61. In this example, center beam 63 bends after extending upward from the lower portion of base portion 61 and extends forward. In front connecting terminal 6, connecting portion 64*a* is formed on the front end of lower beam 64. When connector 1 is being used, connecting portion 64*a* is soldered to the conductor formed on the circuit board to which connector 1 is mounted.

As shown in FIG. 6, when connector 1 is being used, flat electrical wire 100 is inserted from the forward direction between center beam 63 and lower beam 64. Pressing portion 63*a* that projects downward is formed on the lower surface of center beam 63. Pressing portion 63*a* is positioned right in the middle portion of center beam 63. As previously stated, in rear connecting terminal 5, pressing portion 53*a* is formed on the front end of center beam 53. Thus, pressing portion 53*a* and pressing portion 63*a* are positioned differently in the anteroposterior direction.

As previously stated, actuator 3 comprises cam 32 for pushing down on center beam 63. Pressing portion 63*a* pushes flat electrical wire 100 against lower beam 64 when center beam 63 is pushed down via cam 32. This electrically connects front connecting terminal 6 and the conductor pathways formed on flat electrical wire 100. In this example, pressing portion 63*a* contacts the conductor pathways because they are formed on the upper surface of flat electrical wire 100.

Multiple channels 33*a* lined up in the left-right direction are formed on actuator 3. The front end of upper beams 52 and 62 of terminals 5 and 6 fit into channels 33*a*. As previously stated, actuator 3 comprises cams 31 and 32 for pushing down on center beams 53 and 63 of terminals 5 and 6. Cams 31 and 32 are formed inside channels 33*a* and are lined up along the left-right direction in an alternating way. As shown in FIG. 2, cam 31 is positioned between upper beam 52 and center beam 53. As shown in FIG. 5, cam 32 is positioned between upper beam 62 and center beam 63.

Cams 31 and 32 can rotate between the position where center beams 53 and 63 are pressed down (the position of the cams shown in FIGS. 3 and 6; the pushing position hereinafter) and the position where the pressure on center beams 53 and 63 is terminated (the position of the cams shown in FIG. 2 and FIG. 5; the termination position hereinafter). Namely, actuator 3 can rotate forward or backward with cams 31 and 32 as the pivots. Cams 31 and 32 move between the pushing position and the termination position by the rotation of actuator 3. As shown in FIGS. 3 and 6, when actuator 3 rotates forward and is positioned forward of terminal 5 and 6, cams 31 and 32 are positioned in the pushing position. As shown in FIGS. 2 and 5, when actuator 3 rotates backward and is positioned so that it stands facing connector 1, cams 31 and 32 are positioned in the termination position.

As shown in FIG. 2, in rear connecting terminal 5, cam-engaging portion 52*a* is formed on the front end portion of upper beam 52. Cam-engaging portion 52*a* is formed in a needle shape so that it is caught by cam 31. In other words, a concave portion is formed on the lower surface of cam-engaging portion 52*a*, and the upper portion of cam 31 is positioned inside this concave portion. Cam-engaging portion 52*a* regulates the separation of connector 1 from actuator 3 by being caught by cam 31.

As shown in FIGS. 2 and 5, actuator 3 comprises foremost surface 33*b*. Foremost surface 33*b* is positioned more forward than the front end of upper beams 52 and 62 and the front end of center beams 53 and 63 when cams 31 and 32 are positioned at the termination position, i.e., when they are positioned so that actuator 3 is standing up. To be specific, actuator 3 comprises wall portion 33 that divides two channels 33*a* lying next to each other. In this example, the front surface of wall portion 33 functions as foremost surface 33*b*. Foremost surface 33*b* is formed so that it extends in the up-down direction forward of upper beams 52 and 62 and center beams 53 and 63 and protects both the front end of upper beams 52 and 62 and the front end of center beams 53 and 63. Namely, foremost surface 33*b* prevents the tip of flat electrical wire 100 from hitting the front end of upper beams 52 and 62 or the front end of center beams 53 and 63 when flat electrical wire 100 is inserted.

As shown in FIG. 2, inclined surface 55*a* is formed on the foremost portion of the upper surface of center beam 53. Inclined surface 55*a* is formed so that it extends at an angle upward and backward. Inclined surface 55*a* is positioned more backward than pressing portion 53*a*. In this example, inclined surface 55*a* extends at an angle upward and backward from a more backward position than the lowest point of pressing portion 53*a* (the section hitting the surface of flat electrical wire 100). Namely, as shown in FIG. 4, front end 55*b* (the section where the extension at an angle upward and backward begins) of inclined surface 55*a* is positioned more backward than the lowest point of pressing portion 53*a*.

As shown in FIG. 2, convex portion 55 is formed on the upper surface of center beam 53. Convex portion 55 is formed so that it projects at an angle upward and backward from the upper surface of center beam 53, and the lower surface of the rear portion of said convex portion 55 is positioned apart from the upper surface of center beam 53 in the upward direction. As shown in FIG. 4, the distance G from the upper surface of center beam 53 to the lower surface of the rear portion of convex portion 55 gets gradually bigger as it goes backward. In other words, concave portion 55*c* is formed between the rear portion of convex portion 55 and the upper surface of center beam 53, and the width G in the up-down direction of concave portion 55*c* gets gradually bigger as it goes backward. The upper surface of this convex portion 55 functions as inclined surface 55*a*. Inclined surface 55*a* is positioned downward from cam-engaging portion 52*a*, and cam 31 is positioned between inclined surface 55*a* and cam-engaging portion 52*a*. However, back end 55*d* of convex portion 55 is positioned more forward than pressing portion 63*a* of front connecting terminal 6. In addition, back end 55*d* of convex portion 55 is positioned more backward than back end 52*b* of cam-engaging portion 52*a*.

Figure 4:
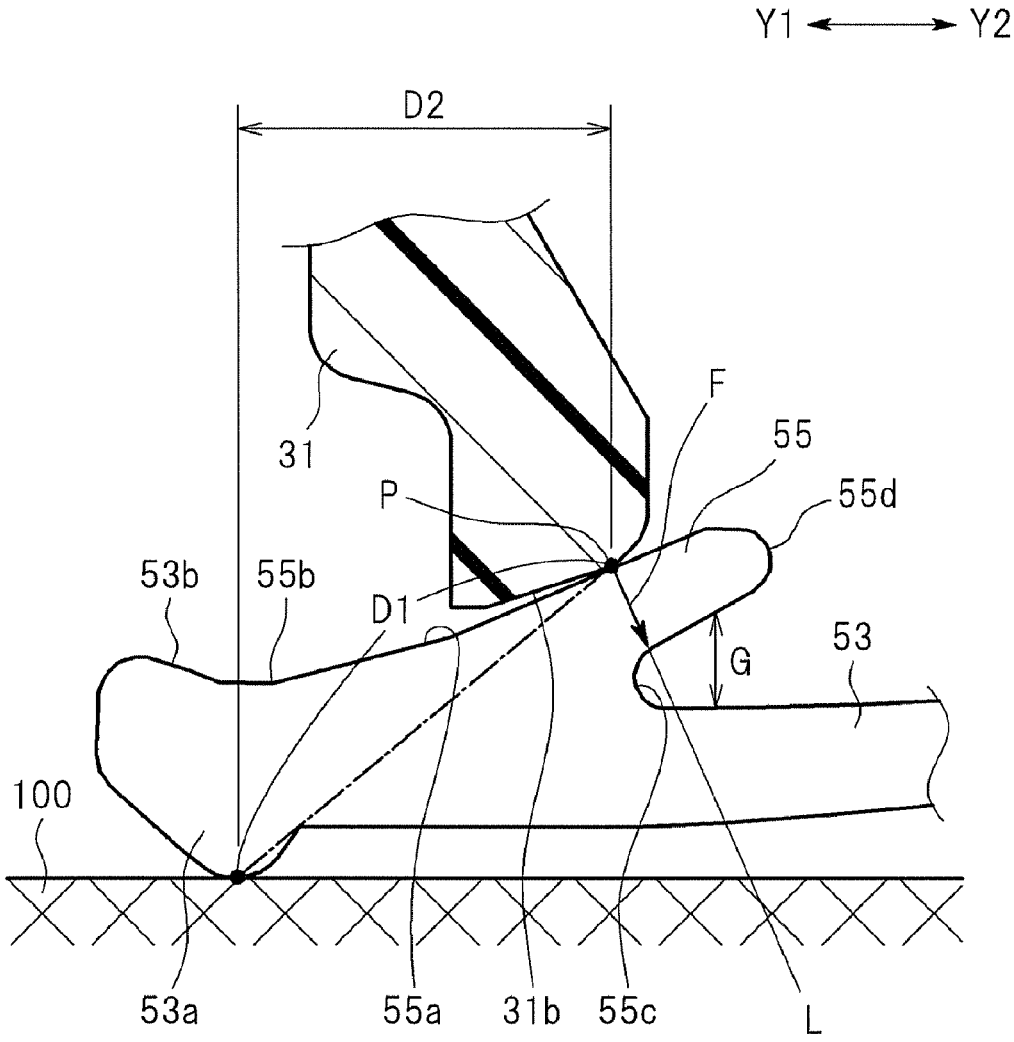
FIG. 4 is an enlarged view of FIG. 3 (the front portion of the center beam of the rear connecting terminal and the cam formed on the actuator are shown in FIG. 4)

As shown in FIG. 4, section 53*b* more forward than inclined surface 55*a* on the upper surface of center beam 53 is slanted upward while simultaneously extending forward. This makes it difficult for cam 31 to slip forward from between center beam 53 and cam-engaging portion 52*a*.

As shown in FIG. 4, cam 31, which is positioned at the pushing position, pushes down on the rear portion of inclined surface 55*a*. To be specific, cam 31 comprises lower contact surface 31*b* that hits the upper surface of center beam 53. When cam 31 is positioned at the termination position, lower contact surface 31*b* is positioned more forward than the upper portion of cam 31 (see FIG. 2). As previously stated, the upper portion of cam 31 gets caught in cam-engaging portion 52*a*. Thus, when cam 31 rotates towards the pushing position from the termination position, cam 31 rotates so that both upper beam 52 and center beam 53 push out with the center being the upper portion of said cam 31. At this point, lower contact surface 31*b* slides backward on top of inclined surface 55*a*. Then when cam 31 reaches the pushing position, lower contact surface 31*b* is positioned on the rear portion of inclined surface 55*a* and presses on the rear portion of said inclined surface 55*a*. As previously stated, inclined surface 55*a* is positioned more backward than pressing portion 53*a*. Thus, position P (the target pushing position) on inclined surface 55*a* where it is pressed by cam 31 becomes a separate position from the lowest point of pressing portion 53*a* in the backward direction.

As shown in FIG. 4, force F that acts on inclined surface 55*a* from cam 31 is perpendicular to inclined surface 55*a*. Namely, the direction of force F that acts on inclined surface 55*a* from cam 31 is the inclined downward and backward direction. In addition, because inclined surface 55*a* is positioned more backward than pressing portion 53*a*, force F that acts on inclined surface 55*a* from cam 31 is generally orientated in the circumferential direction with the lowest point of pressing portion 53*a* as the center.

When center beam 53 is pushed down by cam 31 and the lowest point of pressing portion 53*a* hits flat electrical wire 100, force F generates a moment around the lowest point of pressing portion 53*a*. As a result, the front portion of center beam 53 elastically deforms with the lowest point of pressing portion 53*a* as the fulcrum.

As previously stated, convex portion 55 is formed so that it projects at an angle upward and backward, and its rear portion is positioned apart from the upper surface of center beam 53 in the upward direction. Namely, concave portion 55*c* is formed between the rear portion of convex portion 55 and the upper surface of center beam 53. This makes it easy to produce elastic deformation of the front portion of center beam 53. In short, if concave portion 55*c* is not formed on center beam 53 in this way, the rigidity of the front portion of center beam 53 increases because it gets thicker. As a result, elastic deformation of center beam 53 becomes difficult. In this example, because concave portion 55*c* is formed in this way, the rigidity of the front portion of center beam 53 decreases, and elastic deformation of the front portion of center beam 53 becomes easy. However, as shown in FIG. 4, concave portion 55*c* is indented past the straight line L perpendicular to inclined surface 55*a* at target pushing position P. Thus, when cam 31 pushes inclined surface 55*a*, the rear portion of convex portion 55 also slightly deforms elastically.

As shown in FIG. 5, in front connecting terminal 6, the foremost portion of center beam 63 forms roughly a U-shape. To be specific, center beam 63 comprises first stretching portion 63*b* that extends forward. Center beam 63 comprises second stretching portion that extends backward from first stretching portion 63*b* because it bends back in roughly a U-shape at the front end of first stretching portion 63*b*. Second stretching portion 63*c* is positioned upward from first stretching portion 63*b*. Cam 32 is positioned between second stretching portion 63*c* and upper beam 62.

When actuator 3 is manipulated so that it slips forward, cam 32 rotates to the pushing position from the termination position. Cam 32, which is positioned at the pushing position, pushes down on the tip 63*d* side of second stretching portion 63*c*. In this way, first stretching portion 63*b* is inclined downward, and as a result, pressing portion 63*a* that is formed in the middle of first stretching portion 63*b* pushes flat electrical wire 100 against lower beam 64. Further, when cam 32 pushes down the tip 63*d* side of second stretching portion 63*c*, second stretching portion 63*c* also deforms elastically.

As previously described, in connector 1, rear connecting terminal 5 comprises upper beam 52 that extends forward from base portion 51 and center beam 53 positioned downward from upper beam 52 that extends forward from base portion 51. Pressing portion 53*a* for pushing flat electrical wire 100 is formed on the lower surface of center beam 53. In addition, actuator 3 comprises cam 31 positioned between upper beam 52 and center beam 53. This cam 31 can rotate between the pushing position where center beam 53 is pushed down and the termination position where the pressure on center beam 53 is terminated. Inclined surface 55*a* is formed on the upper surface of center beam 53. This inclined surface 55*a* extends diagonally at an angle upward and backward, and the rear portion of said inclined surface 55*a* is positioned more backward than pressing portion 53*a*. Cam 31, which is positioned at the pushing position, pushes down on the rear portion of inclined surface 55*a*.

According to this connector, the distance D1 (see FIG. 4) between the target pushing position P that is the position on center beam 53 where cam 31 pushes and pressing portion 53*a* is increased, and an increase in the difference D2 (see FIG. 4) between the position of cam 31 in the anteroposterior direction and the position of pressing portion 53*a* is restrained. Namely, because inclined surface 55*a* is inclined, not only is difference D2 increased, distance D1 can be increased. Because distance D1 between pressing portion 53*a* and target pushing position P can be increased in this way, the moment around the lowest point of pressing portion 53*a*, which is caused by the force F incurred by center beam 53, can be increased. As a result, the amount of elastic deformation of center beam 53 is increased, and the contact stability between pressing portion 53*a* and flat electrical wire 100 can be improved.

Figure 7A:
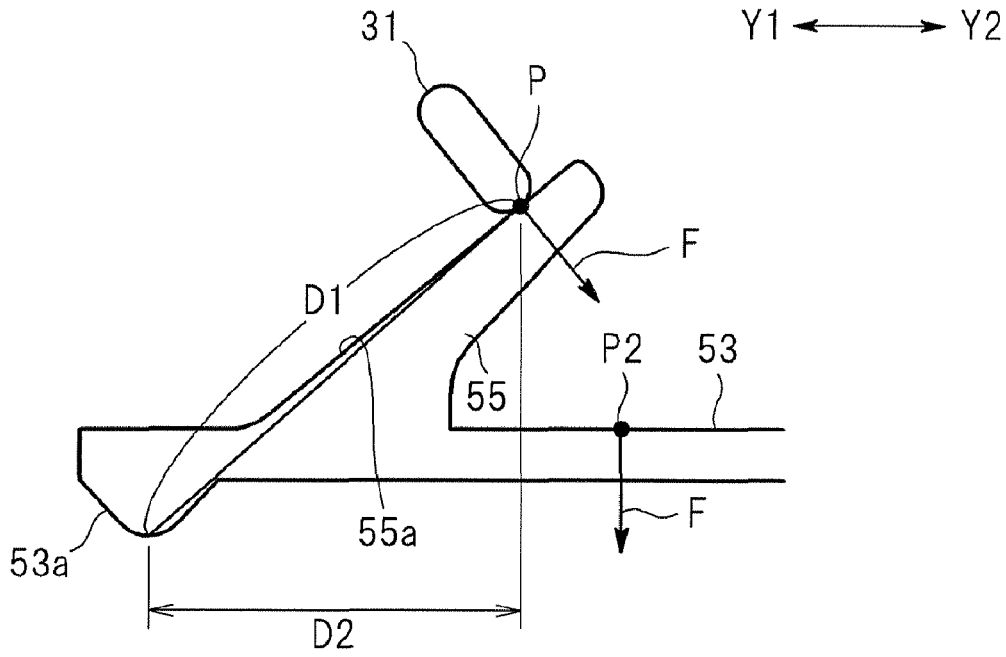
FIG. 7 is a view for describing the effect of the connector of FIG. 1, wherein FIG. 7(*a*) shows the cam and center beam of the connector schematically and FIG. 7(*b*) shows the cam and center beam of a conventional connector schematically.
Figure 7B:
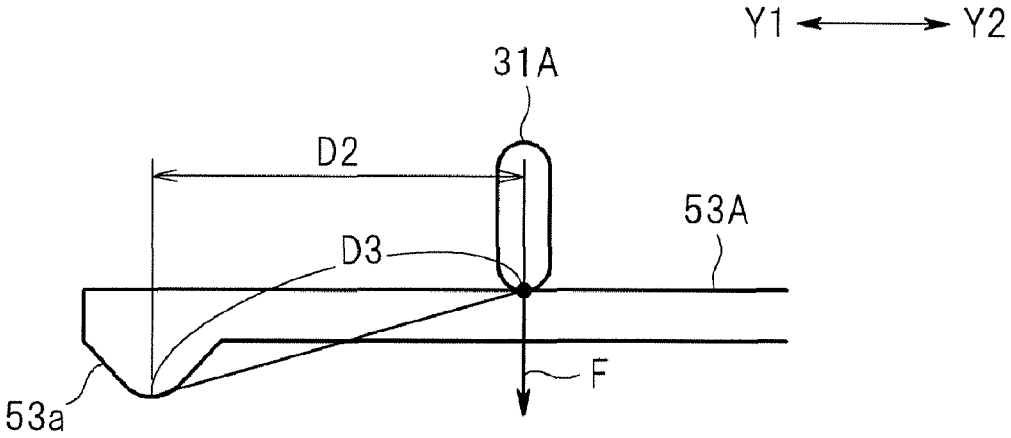

FIG. 7 is a view for describing the effect of connector 1. In FIG. 7(*a*), center beam 53 and cam 31 are drawn schematically. FIG. 7(*b*) shows cam 31A and center beam 53A of a conventional connector. Neither aforementioned inclined surface 55*a* nor convex portion 55 have been formed on center beam 53A, and the upper surface of center beam 53 is formed horizontally. Thus, cam 31A, which is positioned at the pushing position, pushes straight downward on center beam 53. In addition, in FIG. 7(*b*), as with connector 1, cam 31A is positioned only a difference D2 backward from the lowest point of pressing portion 53*a*. When cam 31A pushes down on center beam 53A with force F as with cam 31 of connector 1, the moment around the lowest point of pressing portion 53*a* becomes the product of force F and distance D3 (the distance between the lowest point of pressing portion 53*a* and the position where cam 31A pushes).

Meanwhile, in connector 1, as previously described, cam 31 pushes on the position on inclined surface 55*a* separated on distance D1 from the lowest point of pressing portion 53*a*. Thus, the moment around the lowest point of pressing portion 53*a* becomes the product of force F and distance D1. Namely, this moment is equal to the moment generated when the position P2 on center beam 53 is pushed with force F separated only at the distance D1 from the lowest point of pressing portion 53*a*. Because distance D1 is bigger than distance D3, a bigger moment around the lowest point of pressing portion 53*a* is generated in connector 1 compared to the connector shown in FIG. 7(*b*). As a result, compared to center beam 53A, the amount of elastic deformation of center beam 53 is increased, and the contact stability between pressing portion 53*a* and flat electrical wire 100 can be improved.

In addition, as shown in FIG. 7(*b*), in order to achieve the same amount of elastic deformation as connector 1 in a structure in which the cam pushes the center beam straight down, the position of the cam needs to be separated further backward from the lowest point of pressing portion 53*a* than difference D2. In other words, in connector 1, it is easier to position cam 31 forward compared to the structure shown in FIG. 7(*b*). As a result, it is easier to design a structure in which the foremost surface 33*b* of actuator 3 is positioned more forward than the front end of rear connecting terminal 5 and the front end of front connecting terminal 6.

However, the Present application is not limited to connector 1 described above, and various changes are possible. For example, as described above, the whole of inclined surface 55 was positioned more forward than the lowest point of pressing portion 53*a*. However, the front portion of inclined surface 55*a* may be positioned more forward than the lowest point of pressing portion 53*a*, and only the rear portion of inclined surface 55*a* may be positioned more backward than pressing portion 53*a*.

In addition, as described above, rear connecting terminal 5 comprised lower beam 54, and flat electrical wire 100 was positioned between center beam 53 and lower beam 54. However, lower beam 54 may not be provided on rear connecting terminal 5. In this case, flat electrical wire 100 is positioned on the bottom of housing 2.

In addition, as described above, convex portion 55 projected at an angle upward and backward from the upper surface of center beam 53, and concave portion 55*c* was formed between the rear portion of convex portion 55 and the upper surface of center beam 53. However, this concave portion 55*c* may not be formed in this way.

While a preferred embodiment of the Present application is shown and described, it is envisioned that those skilled in the art may devise various modifications without departing from the spirit and scope of the foregoing Description and the appended Claims.

What is claimed is:

1. A connector which can connect to a flat electrical wire, comprising:

a terminal, the terminal comprising a first beam, extending forward from a base portion, and a second beam, positioned downward from the first beam and extending forward from the base portion, on which is formed a pressing portion, the pressing portion being adapted for pressing the flat electrical wire positioned downward from the second beam;

an actuator, the actuator comprising a cam, the cam being positioned between the first beam and the second beam, and being able to rotate between a pushing position where the second beam is pushed down and a termination position where the pressure on the second beam is terminated; and an inclined surface, the inclined surface extending at an angle upward and backward, of which at least a portion is positioned more backward than the pressing portion, the inclined surface being formed on an upper surface of the second beam, a distance between a top of the inclined surface and the upper surface of the second beam becoming greater as the inclined surface extends backward;

wherein the cam, positioned at the pushing position, pushes at least a portion of the inclined surface such that a portion of the inclined surface deforms elastically.

2. The connector of claim 1, wherein the inclined surface extends at an angle upward and backward from a more backward position than the lowest point of the pressing portion.

3. The connector of claim 1, wherein a foremost surface of the actuator is positioned more forward than a front end of the terminal when the cam is positioned at the termination position.

4. The connector of claim 1, further comprising a convex portion, the convex portion being formed on the second beam, and projects at an angle upward and backward from the upper surface of the second beam.

5. The connector of claim 4, wherein the inclined surface is formed on the upper surface of the convex portion.

* * * * *